US012158145B2

(12) United States Patent
Yang et al.

(10) Patent No.: US 12,158,145 B2
(45) Date of Patent: Dec. 3, 2024

(54) STATIC SCROLL APPLIED IN SCROLL COMPRESSOR AND SCROLL COMPRESSOR

(71) Applicant: GUANGDONG MIDEA ENVIRONMENTAL TECHNOLOGIES CO., LTD., Guangdong (CN)

(72) Inventors: Zhipeng Yang, Guangdong (CN); Fan Yang, Guangdong (CN); Canyu Qian, Guangdong (CN); Xingeng Wu, Guangdong (CN)

(73) Assignee: GUANGDONG MIDEA ENVIRONMENTAL TECHNOLOGIES CO., LTD., Guangdong (CN)

( * ) Notice: Subject to any disclaimer, the term of this patent is extended or adjusted under 35 U.S.C. 154(b) by 0 days.

(21) Appl. No.: 18/244,360

(22) Filed: Sep. 11, 2023

(65) Prior Publication Data

US 2023/0417246 A1 Dec. 28, 2023

Related U.S. Application Data

(63) Continuation of application No. PCT/CN2023/089555, filed on Apr. 20, 2023.

(30) Foreign Application Priority Data

Apr. 20, 2022 (CN) ..... 202220933511.9

(51) Int. Cl.
*F04C 27/00* (2006.01)
*F04C 18/02* (2006.01)
(Continued)

(52) U.S. Cl.
CPC ..... *F04C 18/0269* (2013.01); *F04C 18/0215* (2013.01); *F04C 2240/10* (2013.01); *F04C 2250/30* (2013.01)

(58) Field of Classification Search
CPC ..... F04C 29/12; F04C 29/00; F04C 18/0215; F04C 18/0269; F04C 18/02;
(Continued)

(56) References Cited

U.S. PATENT DOCUMENTS

| | | | | |
|---|---|---|---|---|
| 4,199,308 | A | 4/1980 | McCullough | |
| 2020/0208632 | A1* | 7/2020 | Nagulpelli | F01C 17/066 |
| 2020/0309125 | A1* | 10/2020 | Yamazaki | F04C 23/008 |

FOREIGN PATENT DOCUMENTS

| | | | |
|---|---|---|---|
| CN | 205533209 | U | 8/2016 |
| CN | 110159534 | A | 8/2019 |

(Continued)

OTHER PUBLICATIONS

International Search Report dated Jul. 11, 2023 received in International Application No. PCT/CN2023/089555.

*Primary Examiner* — Deming Wan
(74) *Attorney, Agent, or Firm* — Scully, Scott, Murphy & Presser, P.C.

(57) ABSTRACT

A static scroll and a scroll compressor are provided. The static scroll has a scroll body, a partition, and a protrusion of a closed annular shape. The scroll body has a working fluid inlet and a working fluid outlet, and defines a working fluid flow groove having an open end. The partition is disposed in the working fluid flow groove to divide the working fluid flow groove into a working fluid entry cavity and a working fluid compression cavity. The working fluid entry cavity connects the working fluid inlet with the working fluid compression cavity, and the working fluid outlet is in communication with the working fluid compression cavity. The protrusion is disposed on the scroll body and surrounds the open end of the working fluid flow groove.

14 Claims, 4 Drawing Sheets

(51) Int. Cl.
*F04C 29/00* (2006.01)
*F04C 29/12* (2006.01)

(58) Field of Classification Search
CPC .. F04C 18/0284; F04C 27/005; F04C 27/007; F04C 15/0023
See application file for complete search history.

(56) References Cited

FOREIGN PATENT DOCUMENTS

| | | | |
|---|---|---|---|
| CN | 210164647 | U | 3/2020 |
| CN | 111102193 | A | 5/2020 |
| CN | 217538996 | U | 10/2022 |
| EP | 1160456 | A2 | 12/2001 |

* cited by examiner

STATIC SCROLL APPLIED IN SCROLL COMPRESSOR AND SCROLL COMPRESSOR

CROSS-REFERENCE TO RELATED APPLICATIONS

The present application is a continuation application of International Application No. PCT/CN2023/089555, filed on Apr. 20, 2023, which claims priority to Chinese Patent Application No. 202220933511.9, filed with China National Intellectual Property Administration on Apr. 20, 2022, the entire contents of each of which are incorporated herein by reference for all purposes. No new matter has been introduced.

FIELD

The present disclosure relates to the field of compressors, and more particularly, to a static scroll applied in a scroll compressor and a scroll compressor having the static scroll.

BACKGROUND

In the related art, a scroll compressor includes a compression mechanism for compressing a working fluid such as a refrigerant, and the compression mechanism includes a movable scroll and a static scroll. When the scroll compressor operates, a relative movement occurs between the movable scroll and the static scroll, to achieve an effect of compressing the working fluid. However, during the operation of the compressor, an air suction cavity of the static scroll is not completely closed, and thus the working fluid is prone to leaking from the air suction cavity. Moreover, when the movable scroll and the static scroll move relative to each other to compress the working fluid, the air suction cavity has a great pressure, resulting in a higher input force of the compressor, thereby reducing operation performance of the compressor.

SUMMARY

The present disclosure aims to solve at least one of the technical problems in the related art to some extent.

To this end, according to a first aspect of the present disclosure, a static scroll applicable in a scroll compressor is provided.

According to a second aspect of the present disclosure, a scroll compressor is provided.

According to the present disclosure, a static scroll includes a scroll body, a partition, and a protrusion of a closed annular shape. The scroll body has a working fluid inlet and a working fluid outlet, and defines a working fluid flow groove having an open end. The partition is disposed in the working fluid flow groove to divide the working fluid flow groove into a working fluid entry cavity and a working fluid compression cavity. The working fluid entry cavity connects the working fluid inlet with the working fluid compression cavity, and the working fluid outlet is in communication with the working fluid compression cavity. The protrusion is disposed on the scroll body and surrounds the open end of the working fluid flow groove.

A scroll compressor according to embodiments of the present disclosure includes the static scroll as described above.

Additional aspects and advantages of the present disclosure will be provided at least in part in the following description, or will become apparent at least in part from the following description, or can be learned from practicing of the present disclosure.

DETAILED DESCRIPTION

Figure 1:
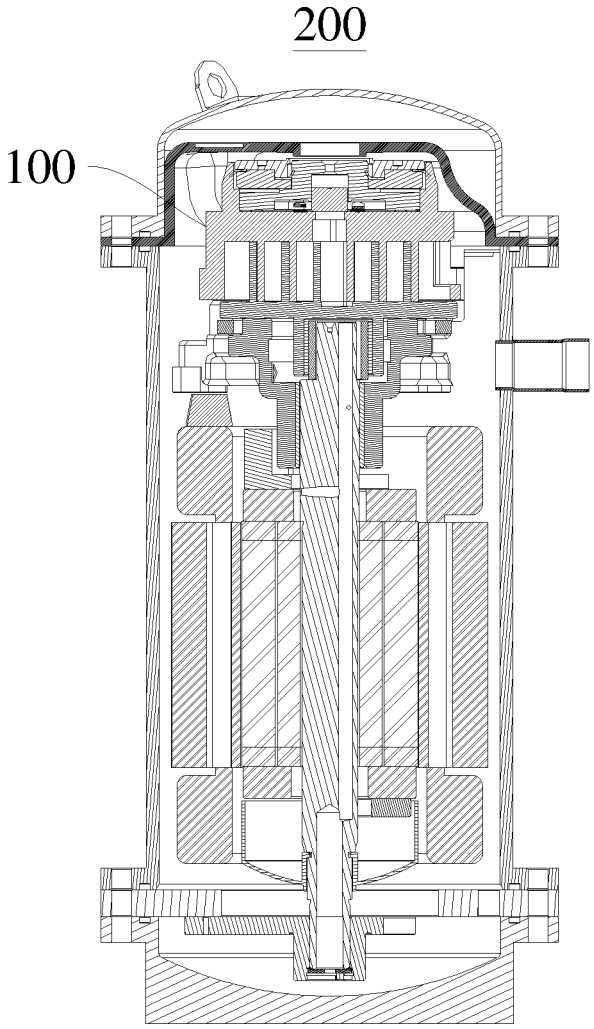
FIG. 1 is a cross-sectional view of a scroll compressor according to an embodiment of the present disclosure.

Embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the accompanying drawings are illustrative only, and are intended to explain, rather than limiting the present disclosure.

A static scroll 100 according to an embodiment of the present disclosure will be described below with reference to the FIGS. 1 to 4. The static scroll 100 may be applied in a scroll compressor 200, and the present disclosure is not limited thereto. The static scroll 100 may also be applied in other devices requiring for the static scroll 100. As an example, in the present disclosure, the static scroll 100 is applied in the scroll compressor 200 for illustration.

Figure 2:
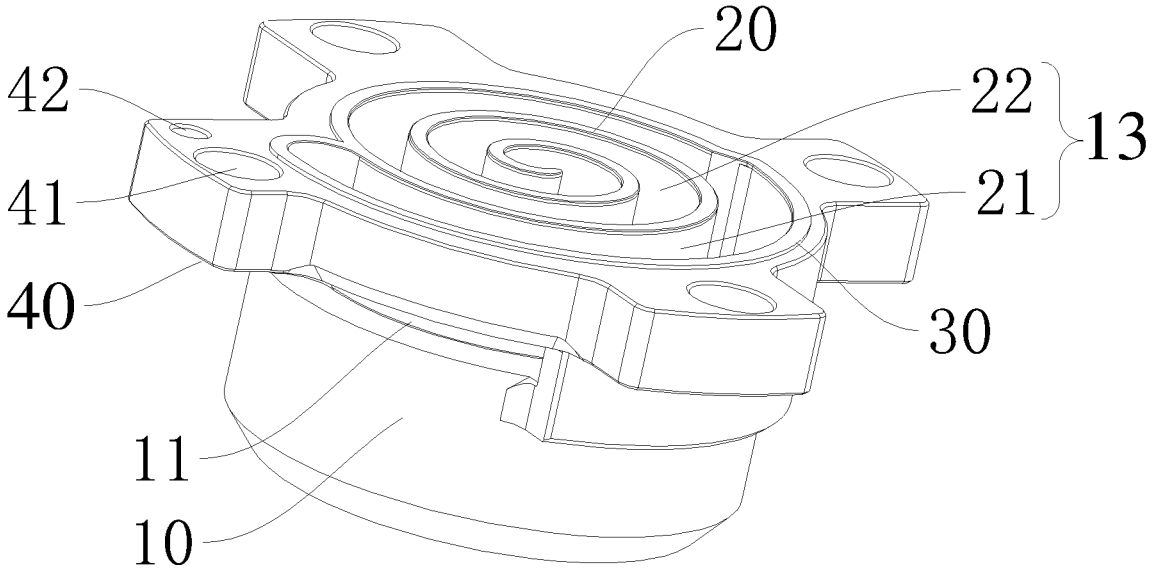
FIG. 2 is a perspective view of a static scroll according to an embodiment of the present disclosure.
Figure 3:
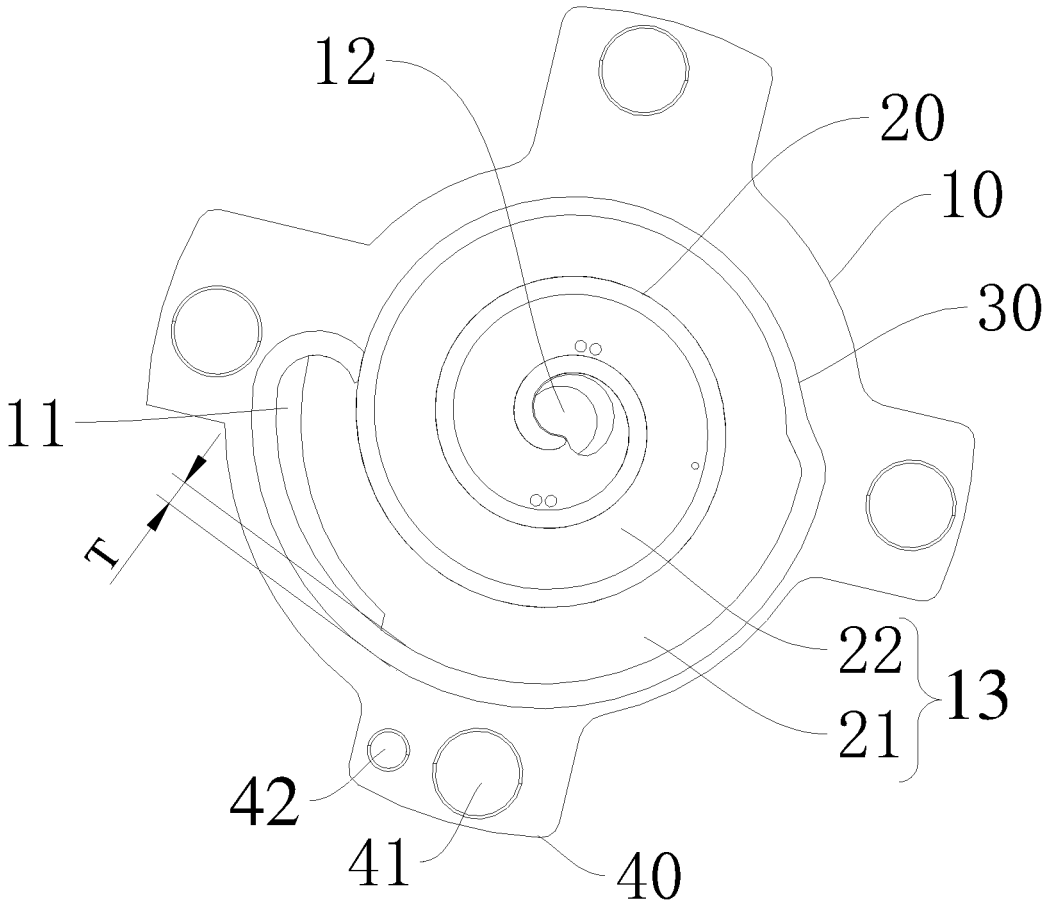
FIG. 3 is a top view of a static scroll according to an embodiment of the present disclosure.

As illustrated in FIG. 2 and FIG. 3, the static scroll 100 according to the embodiment of the present disclosure includes a scroll body 10, a partition 20, and a protrusion 30 of a closed annular shape. The scroll body 10 has a working fluid inlet 11 and a working fluid outlet 12, and defines a working fluid flow groove 13 having an open end. The working fluid flow groove 13 is in communication with both the working fluid inlet 11 and the working fluid outlet 12. The partition is disposed in the working fluid flow groove 13, and can divide the working fluid flow groove 13 into a working fluid entry cavity 21 and a working fluid compression cavity 22. The working fluid entry cavity 21 connects the working fluid inlet 11 with the working fluid compression cavity 22, and the working fluid outlet 12 is in communication with the working fluid compression cavity 22. Further, as illustrated in FIG. 2 and FIG. 3, the partition 20 is constructed as a scroll-shaped plate structure. By arranging the partition 20 in the working fluid flow groove 13, the partition 20 can divide the working fluid flow groove 13 into an arc-shaped working fluid entry cavity 21 and a scroll-shaped working fluid compression cavity 22. The working fluid entry cavity 21 and the working fluid compression cavity 22 serve as working fluid flow channels. A working fluid flows into the working fluid entry cavity 21 through the working fluid inlet 11, then flows into the working fluid compression cavity 22 along the working fluid entry cavity 21, and finally flows out of the working fluid outlet 12. The protrusion 30 is disposed on the scroll body 10 and surrounds the open end of the working fluid flow groove 13, which enables the working fluid entry cavity 21 of the static scroll 100 to be a completely closed space when the scroll compressor 200 is in operation. Furthermore, the protrusion 30 is disposed on an outer surface of the scroll body 10. In addition, the protrusion 30 is disposed on an end surface of the scroll body 10 having the open end of the working fluid flow groove 13.

The protrusion 30 protrudes from a surface of the scroll body 10. The static scroll 100 and a movable scroll of the scroll compressor 200 are assembled together. Rotary teeth of the movable scroll extend into the working fluid entry cavity 21 and the working fluid compression cavity 22, and the protrusion 30 is brought into contact with the movable scroll. During an operation of the scroll compressor 200, the movable scroll moves relative to the static scroll 100, and the working fluid flows into the working fluid entry cavity 21 through the working fluid inlet 11, then flows from the working fluid entry cavity 21 into the working fluid compression cavity 22 along the working fluid entry cavity 21, and is discharged from the static scroll 100 through the working fluid outlet 12 after compressed in the working fluid compression cavity 22. As the movable scroll moves relative to the static scroll 100, the working fluid entry cavity 21 and the working fluid compression cavity 22 can be completely closed through the contact between the protrusion 30 of the closed annular shape and the movable scroll, which can ensure that the working fluid entry cavity 21 and the working fluid compression cavity 22 are completely closed space when the scroll compressor 200 operates, thereby avoiding leakage of the working fluid from a gap between the static scroll 100 and the movable scroll. Therefore, an average pressure inside the working fluid entry cavity 21 can be lowered, which in turn results in a decrease in an input force and an improvement in performance of the scroll compressor 200. Moreover, after the static scroll 100 and the movable scroll are assembled together, the protrusion 30 abuts against the movable scroll, which can reduce a contact area between the static scroll 100 and the movable scroll, thereby reducing abrasion between the static scroll 100 and the movable scroll. Therefore, it is possible to lower power consumption of the scroll compressor 200.

Therefore, by providing the protrusion 30 of the closed annular shape, after the static scroll 100 and the movable scroll are assembled together, the working fluid entry cavity 21 is formed as the completely closed space during the operation of the scroll compressor 200, which can reduce the pressure in the working fluid entry cavity 21 as well as the input force of the scroll compressor 200. As a result, it is possible to enhance the performance of the scroll compressor 200.

In some embodiments of the present disclosure, as illustrated in FIG. 2 and FIG. 3, a height by which the protrusion 30 protrudes from the scroll body 10 is H, where 1 mm≤H. That is, the height by which the protrusion 30 protrudes from the scroll body 10 is greater than or equal to 1 mm. As an embodiment, the height by which the protrusion 30 protrudes from the scroll body 10 is 1.5 mm. After the static scroll 100 and the movable scroll are assembled together, when the height by which the protrusion 30 protrudes from the scroll body 10 is greater than or equal to 1 mm, it is possible to ensure that the protrusion 30 abuts against the movable scroll, which can further ensure that the working fluid entry cavity 21 and the working fluid compression cavity 22 are completely closed, thereby allowing for a suitable height at which the protrusion 30 protrudes from the scroll body 10. Moreover, a structural strength of the protrusion 30 can also be ensured to lower a deformation risk of the protrusion 30. Moreover, it can be ensured that the protrusion 30 abuts against the movable scroll reliably, thereby preventing the working fluid entry cavity 21 and the working fluid compression cavity 22 from being incompletely closed. Meanwhile, it can also ensure that the contact area between the static scroll 100 and the movable scroll decreases.

Further, the height H satisfies: H≤3 mm. That is, a maximum height by which the protrusion 30 protrudes from the scroll body 10 is 3 mm. When the protrusion 30 protrudes from the scroll body 10 by an overly large height, the protrusion 30 is deformed easily. In this case, when the static scroll 100 and the movable scroll are assembled together, the protrusion 30 cannot seal the gap between the static scroll 100 and the movable scroll effectively, and the working fluid may easily leak from the gap between the static scroll 100 and the movable scroll. Moreover, the average pressure in the working fluid entry cavity 21 increases. Therefore, by setting the maximum height by which the protrusion 30 protrudes from the scroll body 10 to be 3 mm, it can further ensure the structural strength of the protrusion 30 and further lower the deformation risk of the protrusion 30. Moreover, it can also further ensure that the protrusion 30 abuts against the movable scroll reliably. Therefore, it is possible to further prevent the working fluid entry cavity 21 and the working fluid compression cavity 22 from being incompletely closed.

In some embodiments of the present disclosure, as illustrated in FIG. 2 and FIG. 3, a thickness of the protrusion 30 is T, and a thickness of the partition 20 is t, where t≤T. As an embodiment, t=T. In this way, a sufficient contact area between the protrusion 30 and the movable scroll and leakproofness between the static scroll 100 and the movable scroll can be ensured after the static scroll 100 and the movable scroll are assembled together. In addition, it is possible to further ensure that the working fluid entry cavity 21 and the working fluid compression cavity 22 are completely closed, allowing for an appropriate thickness of the protrusion 30. Moreover, the structural strength of the protrusion 30 can be further ensured, thereby further reducing the deformation risk of the protrusion 30. The thickness of the protrusion 30 may be set as desired.

Figure 4:
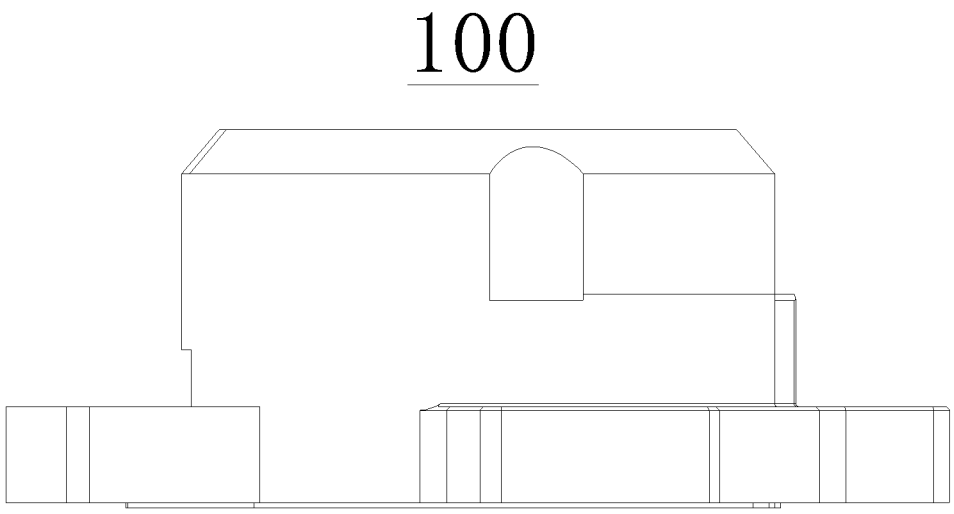
FIG. 4 is a schematic view of a static scroll according to an embodiment of the present disclosure in another direction.

In some embodiments of the present disclosure, as illustrated in FIG. 1 and FIG. 4, the protrusion 30 and the scroll body 10 are integrally formed. In this way, a connection strength between the protrusion 30 and the scroll body 10 can be enhanced, thereby preventing the protrusion 30 from being separated from the scroll body 10, and prolonging service life of the scroll body 10. Moreover, it is possible to enable the protrusion 30 to be tightly connected to the scroll body 10 and avoid the leakage of the working liquid between the protrusion 30 and the scroll body Meanwhile, by arranging the protrusion 30 and the scroll body 10 as an integrated piece, the number of mold required for manufacturing the static scroll 100 can be reduced, and manufacturing cost of the static scroll 100 can be lowered.

Further, the scroll body 10 and the protrusion 30 may be made of metal, and the scroll body 10 may be manufactured through finish-milling.

In some embodiments of the present disclosure, as illustrated in FIG. 2 and FIG. 3, an end portion of the partition 20 close to the open end of the working fluid flow groove 13 extends out of the working fluid flow groove 13, and a height by which the partition 20 extends out of the working fluid flow groove 13 is smaller than or equal to a height by which the protrusion 30 protrudes from the scroll body 10. As an embodiment, the height by which the partition 20 extends out of the working fluid flow groove 13 is equal to the height by which the protrusion 30 protrudes from the scroll body 10. By setting the height by which the partition 20 extends out of the working fluid flow groove 13 to be smaller than or equal to the height by which the protrusion 30 protrudes from the scroll body 10, after the static scroll 100 and the movable scroll are assembled together, it is possible to prevent the protrusion 30 from being separated from the movable scroll due to the contact between the partition 20 and the movable scroll. Moreover, it can ensure that the protrusion and the movable scroll are in reliable contact, and the working fluid entry cavity 21 and the working fluid compression cavity 22 are completely closed. Therefore, it is ensured that the working fluid entry cavity 21 and the working fluid compression cavity 22 are the completely closed space when the scroll compressor 200 is in operation.

In some embodiments of the present disclosure, as illustrated in FIG. 2 and FIG. 3, the working fluid inlet 11 is formed on a side wall of the working fluid flow groove 13. Further, the working fluid inlet 11 penetrates the side wall of the working fluid flow groove 13. The working fluid outlet 12 is formed on a bottom wall of the working fluid flow groove 13. Further, the working fluid outlet 12 penetrates the bottom wall of the working fluid flow groove 13 and is formed at a central position of the bottom wall of the working fluid flow groove 13. When the scroll compressor 200 operates, the movable scroll moves relative to the static scroll 100; the working fluid flows into the working fluid entry cavity 21 through the working fluid inlet 11, and then flows from the working fluid entry cavity 21 into the working fluid compression cavity 22 along the working fluid entry cavity 21; and the working fluid is compressed when flowing towards the working fluid outlet 12 along the working fluid compression cavity 22. Moreover, the compressed working fluid is discharged out of the static scroll 100 from the working fluid outlet 12.

In some embodiments of the present disclosure, as illustrated in FIG. 3, the working fluid entry cavity 21 is located at an outer side of the working fluid compression cavity 22 in a radial direction of the scroll body 10. The working fluid entry cavity 21 and the working fluid compression cavity 22 are formed in the working fluid flow groove 13. The working fluid entry cavity 21 is located at a radial outer side of the working fluid compression cavity 22 in the radial direction of the scroll body 10. The working fluid entry cavity 21 is located close to the side wall of the working fluid flow groove 13. By positioning the working fluid entry cavity 21 at the radial outer side of the working fluid compression cavity 22, it is possible for the working fluid entry cavity 21 to be readily in communication with the working fluid inlet 11, thereby lowering a manufacturing difficulty of the static scroll 100 and enhancing production efficiency of the static scroll 100. Therefore, the working fluid entry cavity 21 and the working fluid compression cavity 22 can be reasonably arranged.

In some embodiments of the present disclosure, as illustrated in FIG. 2 and FIG. 3, the partition 20 and the scroll body 10 are integrally formed. The partition 20 is disposed in the working fluid flow groove 13 and is connected to an inner side wall of the working fluid flow groove 13. Moreover, an end portion of the partition 20 close to the bottom wall of the working fluid flow groove 13 is connected to the bottom wall of the working fluid flow groove 13, and the partition and the scroll body 10 are configured as an integrated piece. In this way, structural strength of the partition 20 and the scroll body 10 can be improved. The partition 20 can be stably mounted in the working fluid flow groove 13 to prevent the partition 20 from moving in the working fluid flow groove 13, thereby ensuring normal cooperation of the static scroll 100 with the movable scroll is ensured. Moreover, it is possible to improve leakproofness of the contact between the bottom wall of the partition 20 and the bottom wall of the working fluid flow groove 13, thereby avoiding cracking at the connection between the partition 20 and the scroll body 10.

In some embodiments of the present disclosure, as illustrated in FIG. 2 and FIG. 3, a plurality of mounting portions 40 are provided on the scroll body 10. Each of the plurality of mounting portions 40 has a mounting hole 41. Further, as illustrated in FIG. 1, the static scroll 100 is disposed inside the scroll compressor 200 and is fixed inside the compressor 200 by the mounting portions 40 provided on the scroll body 10. Further, the plurality of mounting portions 40 are sequentially arranged at intervals in a circumferential direction of the scroll body 10. A same spacing is provided between any two adjacent mounting portions 40. The static scroll 100 may be fixed in the scroll compressor 200 by inserting bolts through the respective mounting holes 41 on the mounting portions 40. Moreover, the static scroll 100 can be fixed in the scroll compressor 200 by using the bolts, which facilitates disassembly and assembly of the static scroll 100, to allow for easy maintenance and replacement of the static scroll 100. Further, a washer may be provided between the bolt and the mounting portion 40. By providing the washer, looseness of a nut engaged with the bolt can be avoided to increase a preload force, thereby improving stability of the static scroll 100 during its operation.

In some embodiments of the present disclosure, as illustrated in FIG. 2 and FIG. 3, at least one of the plurality of mounting portions 40 has a positioning hole 42. It can be understood that at least one mounting portion 40 of the plurality of mounting portions 40 is formed with the positioning hole 42. For example, one of the plurality of mounting portions 40 has the positioning hole 42. A positioning pin may be provided inside the scroll compressor 200. During mounting of the static scroll 100, the static scroll 100 may be pre-positioned by inserting the positioning pin through the positioning hole 42. In this way, the static scroll 100 can be easily mounted and fixed on a mounting structure in the scroll compressor 200. Meanwhile, the positioning pin is engaged with the positioning hole 42, which can avoid positional deviation of the static scroll 100 during use, which in turn prevents operation performance of the compressor 200 from being affected by the positional deviation of the static scroll 100.

As illustrated in FIG. 1 to FIG. 4, the scroll compressor 200 according to another embodiment of the present disclosure includes the static scroll 100 according to the above embodiments. After the static scroll 100 and the movable scroll are assembled together, the protrusion 30 of the closed annular shape is in contact with the movable scroll, enabling the working fluid entry cavity 21 to be the completely closed space when the scroll compressor 200 is in operation. Thus, it is possible to reduce the pressure of the working fluid entry cavity 21 and the input force of the scroll compressor 200. Therefore, the performance of the scroll compressor 200 can be improved.

In the description of this specification, descriptions with reference to the terms "an embodiment," "some embodiments," "schematic embodiments," "examples," "specific examples," or "some examples", etc. mean that specific features, structure, materials or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics may be combined in any one or more embodiments or examples in a suitable manner.

Although the embodiments of the present disclosure are illustrated and described above, it can be understood by those of ordinary skill in the art that various changes, modifications, substitutions and alterations may be made to these embodiments without departing from the principles and spirit of the present disclosure. The scope of the present disclosure is defined by the claims and their equivalents.

What is claimed is:

1. A static scroll comprising:

a scroll body having a working fluid inlet and a working fluid outlet and defining a working fluid flow groove having an open end;

a partition disposed in the working fluid flow groove to divide the working fluid flow groove into a working fluid entry cavity and a working fluid compression cavity, the working fluid entry cavity connecting the working fluid inlet with the working fluid compression cavity, and the working fluid outlet being in communication with the working fluid compression cavity; and a protrusion of a closed annular shape, the protrusion being disposed on the scroll body adjacent to and surrounding the open end of the working fluid flow groove, wherein an end portion of the partition close to the open end of the working fluid flow groove extends out of the working fluid flow groove, and wherein a height by which the end portion of the partition extends out of the working fluid flow groove is smaller than or equal to a height by which the protrusion protrudes from the scroll body.

2. The static scroll according to claim 1, wherein the height by which the protrusion protrudes from the scroll body is H, where 1 mm≤H.

3. The static scroll according to claim 2, wherein H≤3 mm.

4. The static scroll according to claim 2, wherein:

a thickness of the protrusion is T; and a thickness of the partition is t, where t≤T.

5. The static scroll according to claim 1, wherein:

a thickness of the protrusion is T; and a thickness of the partition is t, where t≤T.

6. The static scroll according to claim 1, wherein the protrusion and the scroll body are integrally formed.

7. The static scroll according to claim 1, wherein:

the working fluid inlet is formed on a side wall of the working fluid flow groove; and the working fluid outlet is formed on a bottom wall of the working fluid flow groove.

8. The static scroll according to claim 1, wherein the working fluid entry cavity is located at an outer side of the working fluid compression cavity in a radial direction of the scroll body.

9. The static scroll according to claim 1, wherein the partition and the scroll body are integrally formed.

10. The static scroll according to claim 1, wherein a plurality of mounting portions is provided on the scroll body, each of the plurality of mounting portions having a mounting hole.

11. The static scroll according to claim 10, wherein at least one of the plurality of mounting portions has a positioning hole.

12. A scroll compressor comprising the static scroll according to claim 1.

13. The static scroll according to claim 1, wherein, when the static scroll is engaged against a movable scroll, the protrusion is configured to completely enclose the working fluid flow groove through contact between the protrusion and the movable scroll, the protrusion being configured to inhibit an outflow of a working fluid from between the static scroll and the movable scroll.

14. The static scroll according to claim 1, wherein the protrusion comprises an inner wall that is aligned with and extends from a wall of the working fluid flow groove.

* * * * *